US007530200B2

(12) United States Patent
Gramling

(10) Patent No.: US 7,530,200 B2
(45) Date of Patent: May 12, 2009

(54) GUTTER RETAINING SYSTEM

(76) Inventor: Karl Gramling, 8000 IH 10 West, Suite 600, San Antonio, TX (US) 78230

( * ) Notice: Subject to any disclaimer, the term of this patent is extended or adjusted under 35 U.S.C. 154(b) by 767 days.

(21) Appl. No.: 10/939,246

(22) Filed: Sep. 10, 2004

(65) Prior Publication Data

US 2005/0144851 A1 Jul. 7, 2005

Related U.S. Application Data

(63) Continuation-in-part of application No. 10/693,473, filed on Oct. 24, 2003, now Pat. No. 7,082,723, and a continuation-in-part of application No. 10/623,222, filed on Jul. 21, 2003, now Pat. No. 6,935,074.

(51) Int. Cl.
*E04D 13/00* (2006.01)

(52) U.S. Cl. ..... 52/11; 52/12

(58) Field of Classification Search ..... 52/11, 52/12, 15

See application file for complete search history.

(56) References Cited

U.S. PATENT DOCUMENTS

| | | | | |
|---|---|---|---|---|
| 2,784,687 | A * | 3/1957 | Hovey | 52/11 |
| 3,296,749 | A | 1/1967 | Cotter | |
| 3,333,803 | A | 8/1967 | Landis | |
| 3,344,562 | A | 10/1967 | Miles et al. | |
| 3,550,381 | A | 12/1970 | South | |
| 3,612,453 | A | 10/1971 | Zimmer | |
| 4,195,452 | A | 4/1980 | Smith et al. | |
| 4,241,548 | A | 12/1980 | Rowe | |
| 4,271,643 | A | 6/1981 | Sweers | |
| 4,300,319 | A | 11/1981 | Frost et al. | |
| 4,705,242 | A | 11/1987 | Yost | |
| 4,713,915 | A | 12/1987 | Sweers | |
| 4,745,657 | A * | 5/1988 | Faye | 16/226 |
| 4,912,888 | A | 4/1990 | Martin | |
| 5,740,633 | A | 4/1998 | Champagne | |
| 5,845,435 | A * | 12/1998 | Knudson | 52/11 |
| 5,960,591 | A * | 10/1999 | Schluter | 52/11 |
| 6,254,039 | B1 * | 7/2001 | Zimmerman | 248/48.2 |
| 6,260,307 | B1 * | 7/2001 | Richardson | 52/11 |
| 6,993,871 | B2 * | 2/2006 | Richard et al. | 52/11 |

* cited by examiner

*Primary Examiner*—Basil Katcheves
(74) *Attorney, Agent, or Firm*—Gunn, Lee & Cave, P.C.

(57) ABSTRACT

A gutter retaining system incorporating a gutter clip with a gutter and retaining member. Retaining member is placed along the eaves. The gutter clip has L-portion and back portion. Back portion includes upper u-portion with hanger for slipping gutter clip over gutter for securing to gutter clip. Gutter clip has nib end with locking tip. Nib end fits within retaining member to secure gutter clip and gutter in place. L-portion fits between the gutter and building where an additional piece of board is included. The gutter clip is scored between the back portion and L-portion allowing separation if needed. A second embodiment provides a retaining member for use with metal flashing. Additional embodiments provided modified retaining members which permit the gutter system to be held against a building with straight fascia, slanted fascia, and trim board and which permit free floating attachment of a debris guard.

16 Claims, 10 Drawing Sheets

GUTTER RETAINING SYSTEM

This is a continuation in part application claiming priority to U.S. patent application Ser. No. 10/623,222 filed Jul. 21, 2003 now U.S. Pat. No. 6,935,074 and U.S. patent application Ser. No. 10/693,473 filed Oct. 24, 2003 now U.S. Pat. No. 7,082,723.

BACKGROUND OF THE INVENTION

1. Field of the Invention

Applicant's invention relates to a gutter retaining system for affixing a gutter to a building. More specifically, the present invention relates to an interlocking system that incorporates a clip for affixing gutters to a retaining member on the eaves of a building that obviates the need for using nails or screws within the gutter itself, and to the structure installed according to the system, both preassembly and as assembled. This interlocking system can incorporate a debris guard that prevents debris from enter and ultimately clogging the gutters.

2. Background Information

For years property owners have struggled with the destructive effects of water on their buildings. However, by channeling the water away from the structure, building owners can reduce the damage caused by water. This can be accomplished through the use of a gutter system. Gutters are troughs that channel water from the eaves, being the horizontal lower edge of a roof, of a building to the downspouts. The downspouts are essentially drainpipes that drain water from the roof gutters. Gutters are a critical component of a building because they prevent moisture damage by channeling water off the roof and away from the foundation. But any damaged lengths of gutter or drain pipe caused by wear, improper installation, or sagging can cause leaks which can result in water damage to the building.

Traditionally, gutters have been attached by nailing the gutter directly to the building. Building contractors typically used a spike and ferrule system, in which a narrow, tubular spacer, the ferrule, is placed between the front face of a gutter and its rear face, ensuring that the front face remains at a uniform distance from the rear face. A spike or long nail, is then punched through the outside of the front face of the gutter, through the ferrule, through the back face of the gutter, and into the wall or fascia of the structure.

Using the nail in this manner ruins the finished appearance of the gutter. In addition, once the gutter is installed it ends up with its front face tilted forward towards the ground. Once this occurs the captured rainwater and other material tends to pool along the outer edge of the gutter. The weight of this material creates a moment at the point of insertion of the nail, resulting in a force pulling the gutter away from the wall. Further, while this manner of installation has the effect (at least temporarily) of securing the gutter in place, it does not ensure that water will not run behind the gutter. In any structure where water is allowed to run and collect behind the gutter, eventually the integrity of the wood begins to weaken and the moment forces referred to above slowly pull the nail and the gutter away from the building. In periods of adverse weather, high winds can accelerate the process by getting behind the gutter and forcing it completely away from the building.

The utilization of gutter hangers is the most common way in which installers have tried to improve the integrity and life of gutter systems. In this application, a modified spacer is used, shaped like a flat plate, with both ends mined upward. One end of this spacer is inserted under the lip of the front face of the gutter, while the second end, with a pre-punched nail hole, is placed against the rear face of the gutter. A nail or screw is then inserted through the nail hole, through the rear face of the gutter, and into the building wall. A variation of this method includes placing the second end of the spacer over the top of the rear face of the gutter. The spacer is then nailed directly into the roof decking of the building or to the face of the wall, under any existing shingles. These methods of installation eliminate the unsightly appearance previously created by installing the nail or screw through the front face of the gutter. However, these hangers do not prevent the collection of water behind the gutter, nor relieve the moment created by the weight of the water pooling outwardly within the gutter.

A further problem occurs with different types of construction. The building may or may not include an additional small piece of fascia board under the eaves which is not as long as the gutter. If a piece of fascia board does exist under the eaves and the gutter system is in turn nailed to it, over time the portion of the gutter which extends below the fascia board will sag towards the building. This sagging can eventually cause leaks. Where no additional fascia board exists, this type of sagging is not seen.

Because of the problems which have been associated with traditional gutter systems and methods of installation, there is a need for a strong, sturdy gutter system. In addition, this system should be adaptable to different types of construction that may or may not incorporate an additional piece of fascia board. It is desirable that installation be easy, while ensuring that any interlocking aspect of the system is not compromised due to the primary construction of the building nor during periods of high winds or other adverse weather conditions. Preferably, this system should redistribute the water and other material captured within the gutter, such that all moments that could result are negated. Furthermore, the system should prevent any sagging due to construction that incorporates an additional piece of fascia board and incorporating a debris guard preventing the accumulation of debris.

SUMMARY OF THE INVENTION

The present invention embodies a gutter retaining system for affixing a rain gutter under the eaves of a building having a pitched roof. The gutter retaining system incorporates a gutter clip which is used in conjunction with a rain gutter and a retaining member. The gutter clip has an L-portion and a back portion. The back portion includes an upper u-portion with a hanger which is used to slip the gutter clip over the gutter. The back portion of the gutter clip also includes a nib end with a locking tip. Nib end extends slightly beyond the dimensions of the hanger and can fit within a hooked portion of the retaining member. This allows the locking tip to secure the gutter clip and gutter in place along the eaves of the building.

The L-portion of the gutter clip is useful on buildings which incorporate an additional piece of fascia board along the eaves in the construction. The L-portion fits between the gutter and the wall of the building, incorporating a base extension which can be fit against the building. In addition, the gutter clip is scored between the back portion and the L-portion which allows these two portions to be separated when desired, such as in the situation where no additional piece of fascia board is found along the eaves of the building. Where the L-portion is removed from the back portion, the L-portion would be discarded. In this situation, the vertical portion of the back portion presses against the building.

In a second embodiment, a retaining member is provided to permit the gutter system to be held against a building incorporating metal flashing. Retaining member has a mounting lip contiguous with an upper vertical section. At the junction between the mounting lip and upper vertical section is one end of horizontal section. The remainder of horizontal section drops into return which ends in a hooked portion.

In third through eighth embodiments, modified retaining members are provided to permit the gutter system to be held against a building with straight fascia, slanted fascia, and trim board as well as to permit the free floating attachment of a debris guard.

In a ninth embodiment, a modified gutter clip is provided. The modified gutter clip has a base, a vertical portion, and an elongated hanger portion. The vertical portion includes an upper u-portion which is used to slip the gutter clip over the gutter. Adjacent the upper u-portion is one end of elongated hanger portion. The opposing end of elongated hanger portion is designed to mate with lip of gutter. The base of the modified gutter clip is useful on buildings which incorporate an additional piece of trim board along the eaves in the construction. The base fits between the gutter and the wall of the building. In addition, the modified gutter clip can be scored between the vertical portion and the base which allows these two portions to be separated when desired, such as in the situation where no additional piece of trim board is found along the eaves of the building. Where the base is removed from the vertical portion, the base would be discarded. In this situation, the vertical portion presses against the building.

DETAILED DESCRIPTION OF THE PREFERRED EMBODIMENT

Figure 1:
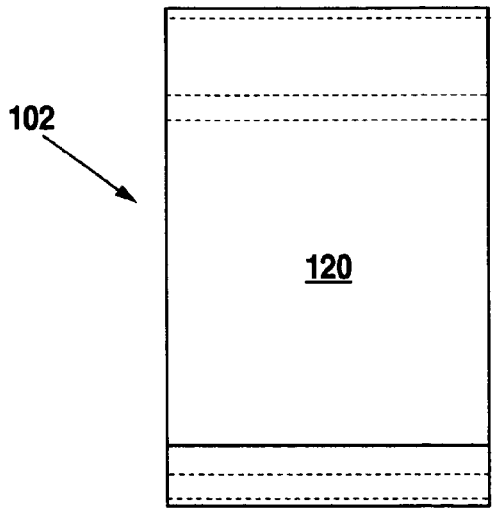
FIG. 1 is a front view of the gutter clip component of the preferred embodiment of the present invention.
Figure 2:
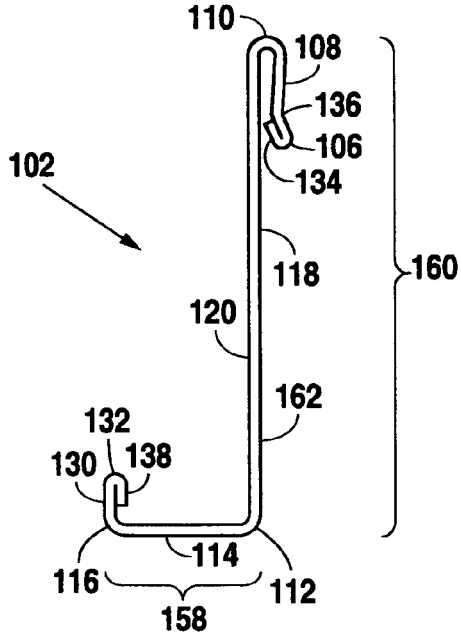
FIG. 2 is a side view of the gutter clip component of the preferred embodiment of the present invention.

In FIGS. 1 and 2 a front view and side view, respectively, of the gutter clip 102 of the preferred embodiment of the present invention are shown. Gutter clip 102 is essentially L-shaped incorporating an L-portion 158, a back portion 160, a front face 120 and back face 118. Beginning at the back portion 160 is locking tip 134 which is contiguous into nib end 106. Nib end 106 transitions into hanger 108 via junction 136. Hanger 108 is contiguous with upper u-portion 110. Upper u-portion 110 continues into vertical portion 162. Vertical portion 162 transitions into L-portion 158 which begins at first elbow 112. Scoring can be used on first elbow 112 to allow L-portion 158 to be easily separated from back portion 160. First elbow 112 turns into base 114 which proceeds into second elbow 116. Second elbow 116 turns up into base extension 130. Base extension 130 is contiguous with lower u-portion 132, lower u-portion 132 being completed at end 138.

Figure 3:
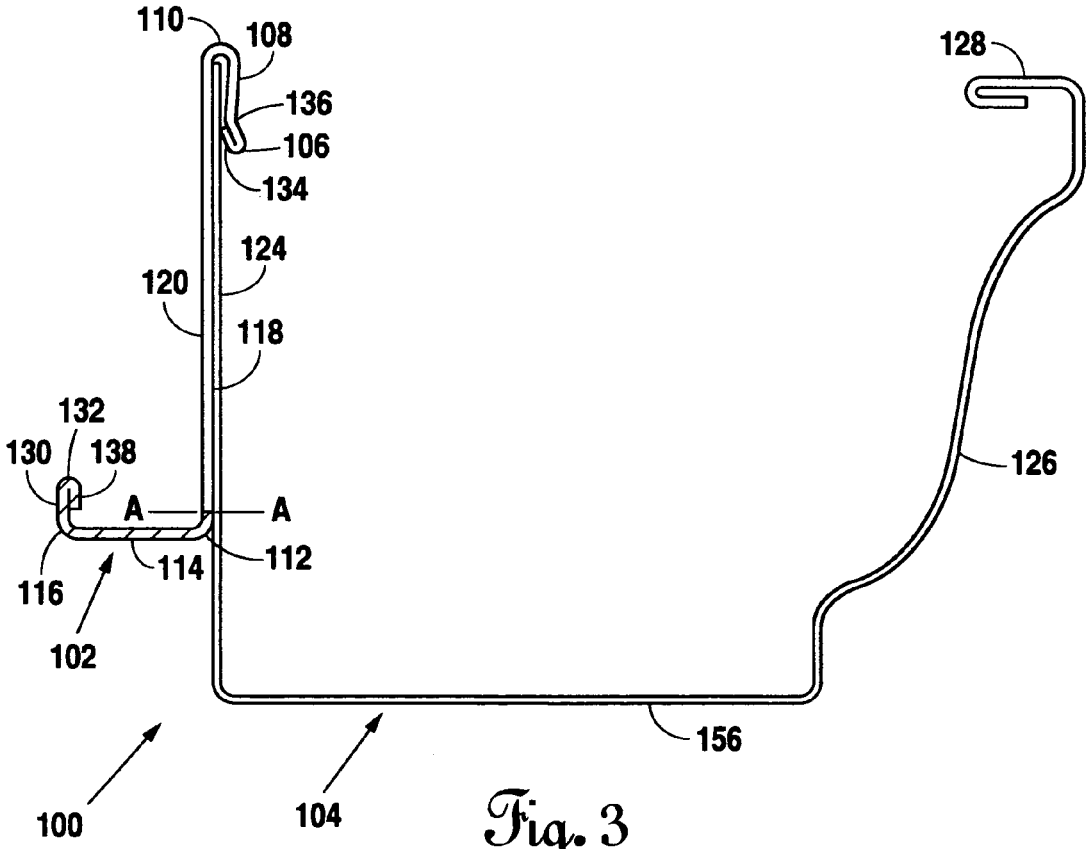
FIG. 3 is a cross-section view of the gutter clip component of the preferred embodiment of the present invention shown overlapping a gutter.

FIG. 3 shows a cross section view of the gutter clip 102 of the preferred embodiment of the present invention overlapping a gutter 104. Gutter clip 102, gutter 104, and retaining member 122 make up a gutter retaining system 100. Gutter clip 102 is as mentioned essentially L-shaped incorporating an L-portion 158 (See FIG. 2), a back portion 160 (See FIG. 2), a front face 120 and back face 118. Beginning at the back portion 160 (See FIG. 2) is locking tip 134 which is adjacent nib end 106. Nib end 106 transitions into hanger 108 via junction 136. Hanger 108 continues into upper u-portion 110. The portion of gutter clip 102 from locking tip 134 to upper u-portion 110 fits inside the back wall 124 of gutter 104. Upper u-portion 110 can be crimped to secure gutter clip 102 snugly to gutter 104. Back face 118 fits against the outside of the back wall 124 of gutter 104 from upper u-portion 110 to first elbow 112. Upper u-portion 110 of gutter clip 102 continues into vertical portion 162. Vertical portion 162 transitions into L-portion 158 (See FIG. 2) which begins at first elbow 112. First elbow 112 turns into base 114 which proceeds into second elbow 116. Second elbow 116 turns up into base extension 130. Base extension 130 is contiguous with lower u-portion 132, lower u-portion 132 being completed at end 138. The remainder of gutter 104 includes a gutter channel 156, front wall 126 and lip 128.

Figure 4A:
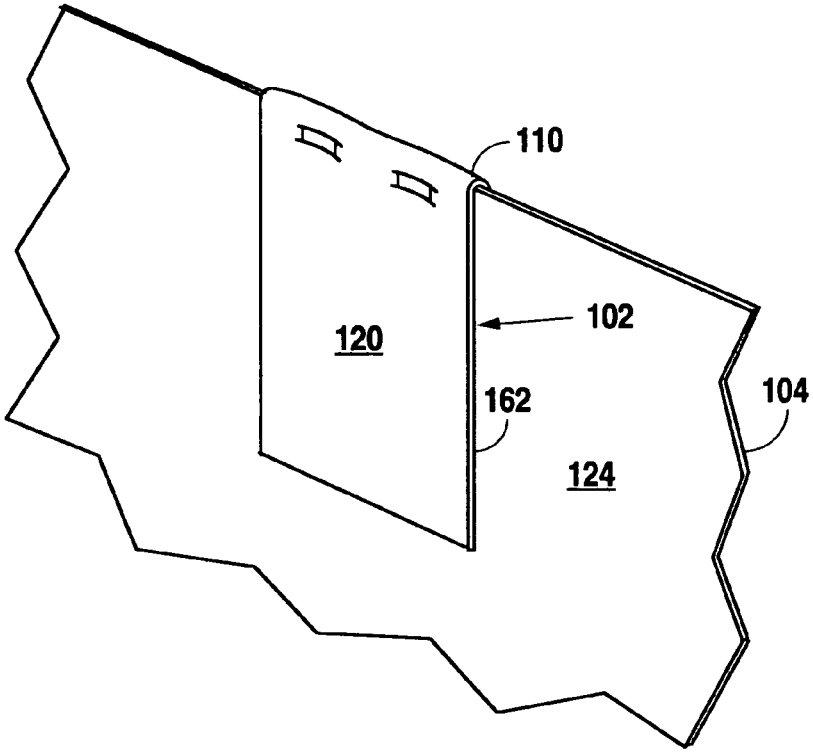
FIG. 4A is a perspective view of the gutter clip component of the preferred embodiment of the present invention with the L-portion removed.

FIG. 4A is a perspective view of the gutter clip 102 of the preferred embodiment of the present invention with the L-portion 158 (See FIG. 2) removed. Beginning at the back portion 160 (See FIG. 2) is locking tip 134 (See FIG. 3) which is contiguous into nib end 106 (See FIG. 3). Nib end 106 (See FIG. 3) transitions into hanger 108 (See FIG. 3) via junction 136 (See FIG. 3). Hanger 108 (See FIG. 3) is contiguous with upper u-portion 110. Upper u-portion 110 can be crimped to secure gutter clip 102 snugly to gutter 104. Back face 118 (See FIG. 3) fits against the outside of the back wall 124 of gutter 104. Upper u-portion 110 of gutter clip 102 continues into vertical portion 162.

Figure 4B:
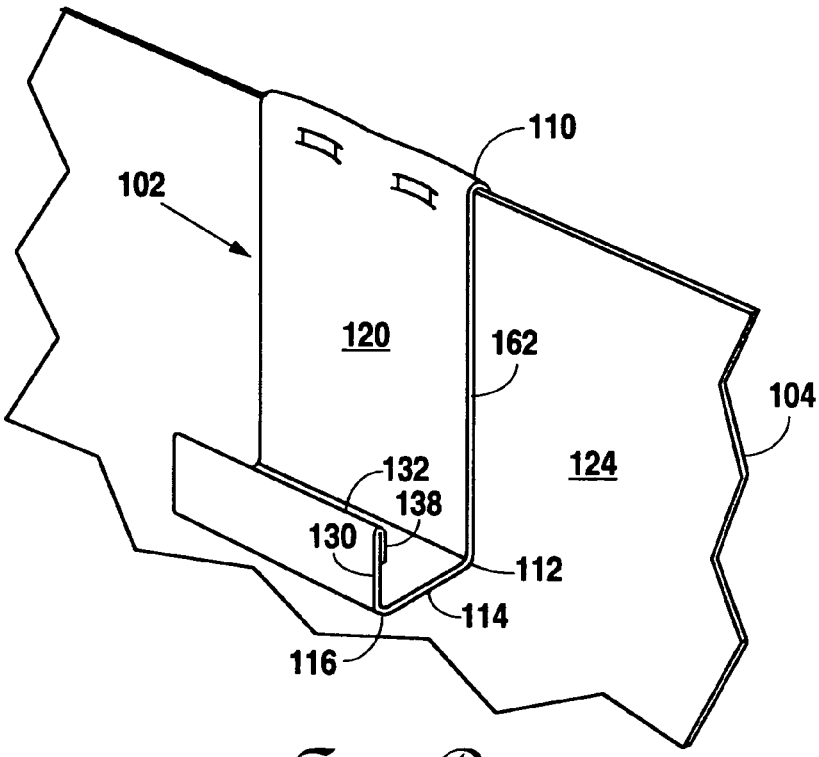
FIG. 4B is a perspective view of the gutter clip component of the preferred embodiment of the present invention retaining the L-portion.

In FIG. 4B a perspective view of the gutter clip 102 of the preferred embodiment of the present invention retaining the L-portion 158 (See FIG. 2) is shown. Beginning at the back portion 160 (See FIG. 2) is locking tip 134 (See FIG. 3) which is contiguous into nib end 106 (See FIG. 3). Nib end 106 (See FIG. 3) transitions into hanger 108 (See FIG. 3) via junction 136 (See FIG. 3). Hanger 108 (See FIG. 3) is contiguous with upper u-portion 110. The portion of gutter clip 102 from locking tip 134 (See FIG. 3) to upper u-portion 110 fits inside the back wall 124 of gutter 104. Upper u-portion 110 can be crimped to secure gutter clip 102 snugly to gutter 104. Back face 118 (See FIG. 3) fits against the outside of the back wall 124 of gutter 104 from upper u-portion 110 to first elbow 112. Upper u-portion 110 of gutter clip 102 continues into vertical portion 162. Vertical portion 162 transitions into L-portion 158 (See FIG. 3) which begins at first elbow 112. First elbow 112 turns into base 114 which proceeds into second elbow 116. Second elbow 116 turns up into base extension 130. Base extension 130 is contiguous with lower u-portion 132, lower u-portion 132 being completed at end 138.

Figure 5:
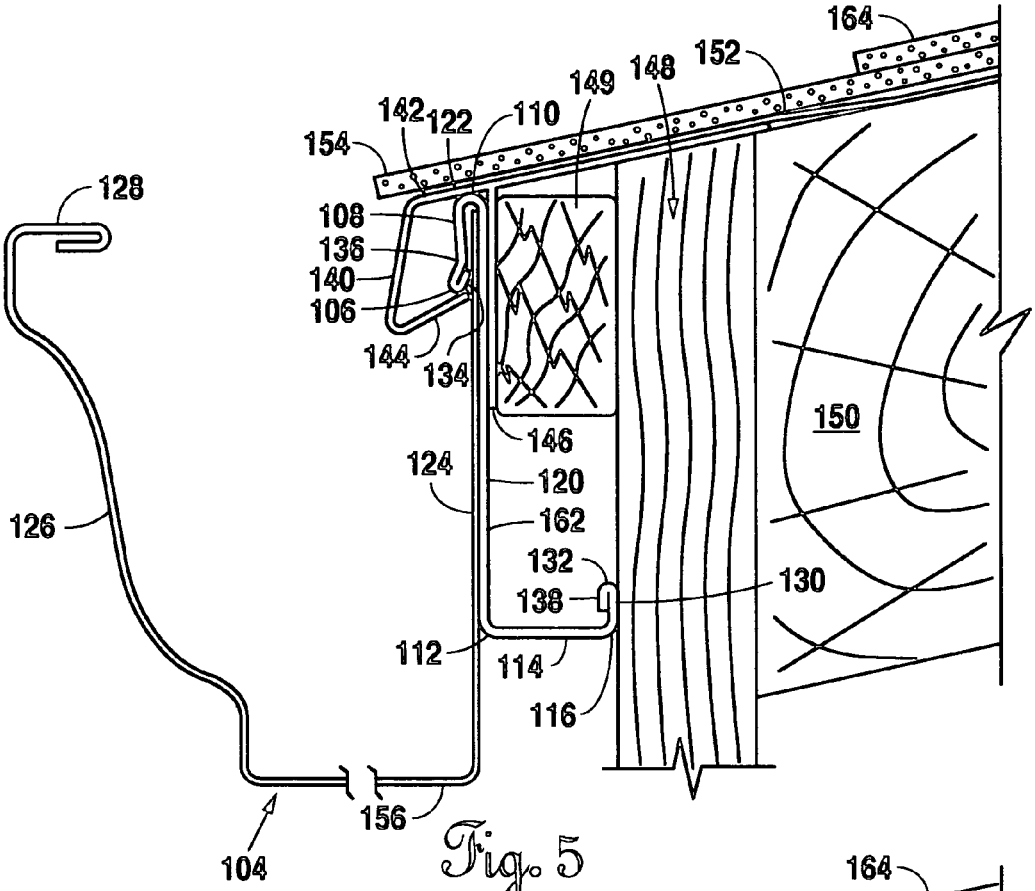
FIG. 5 is a cross-section view of the gutter clip component of the preferred embodiment of the present invention retaining the L-portion as shown with a gutter and retaining member against a building.

FIG. 5 is a cross-section view of the gutter clip 102 of FIG. 4B of the preferred embodiment of the present invention retaining the L-portion 158 (See FIG. 2) as shown with a gutter 104 and retaining member 122 against a building 150. Beginning at the back portion 160 (See FIG. 2) is locking tip 134 which is contiguous into nib end 106. Nib end 106 transitions into hanger 108 via junction 136. Hanger 108 is contiguous with upper u-portion 110. The portion of gutter clip 102 from locking tip 134 to upper u-portion 110 fits inside the back wall 124 of gutter 104. Upper u-portion 110 can be crimped to secure gutter clip 102 snugly to gutter 104.

Front face 120 fits against mounting lip 146 of retaining member 122. Mounting lip 146 ends in horizontal section 142. One end of horizontal section 142 proceeds under the roof 152 tiles 164 while the remaining end drops into a return 140. Return 140 ends in hooked portion 144. Nib end 106 extends slightly beyond the dimensions of hanger 108 and therefore can fit within hooked portion 144 to allow locking tip 134 to secure gutter clip 102 and gutter 104 in place. The back of mounting lip 146 presses against a trim board 149 in front of fascia board 148 on building 150. The thickness of L-portion 158 (See FIG. 2) is approximately equal to the thickness of fascia board 148 to allow for base extension 130 to fit properly against building 150. In buildings 150 which incorporate this trim board 148, L-portion 158 (See FIG. 2) provides stability to gutter 104 to prevent gutter 104 from sagging towards building 150. The vertical portion 162 of gutter clip 102 as well as the upper u-portion 110, hanger 108, nib end 106, junction 136 and locking tip 134 of gutter clip 102 are positioned under the eaves 154 of building 150. A portion of horizontal section 142, return 140 and hooked portion 144 of retaining member 122 are positioned under the eaves 154 of building 150 as is gutter 104.

Back face 118 (See FIG. 3) fits against the outside of the back wall 124 of gutter 104 from upper u-portion 110 to first elbow 112. Upper u-portion 110 of gutter clip 102 continues into vertical portion 162. Vertical portion 162 transitions into L-portion 158 (See FIG. 2) which begins at first elbow 112. First elbow 112 turns into base 114 which proceeds into second elbow 116. Second elbow 116 turns up into base extension 130. Base extension 130 is designed to fit against building 150. Base extension 130 is contiguous with lower u-portion 132, lower u-portion 132 being completed at end 138. The remainder of gutter 104 includes a gutter channel 156, front wall 126 and lip 128.

Figure 6:
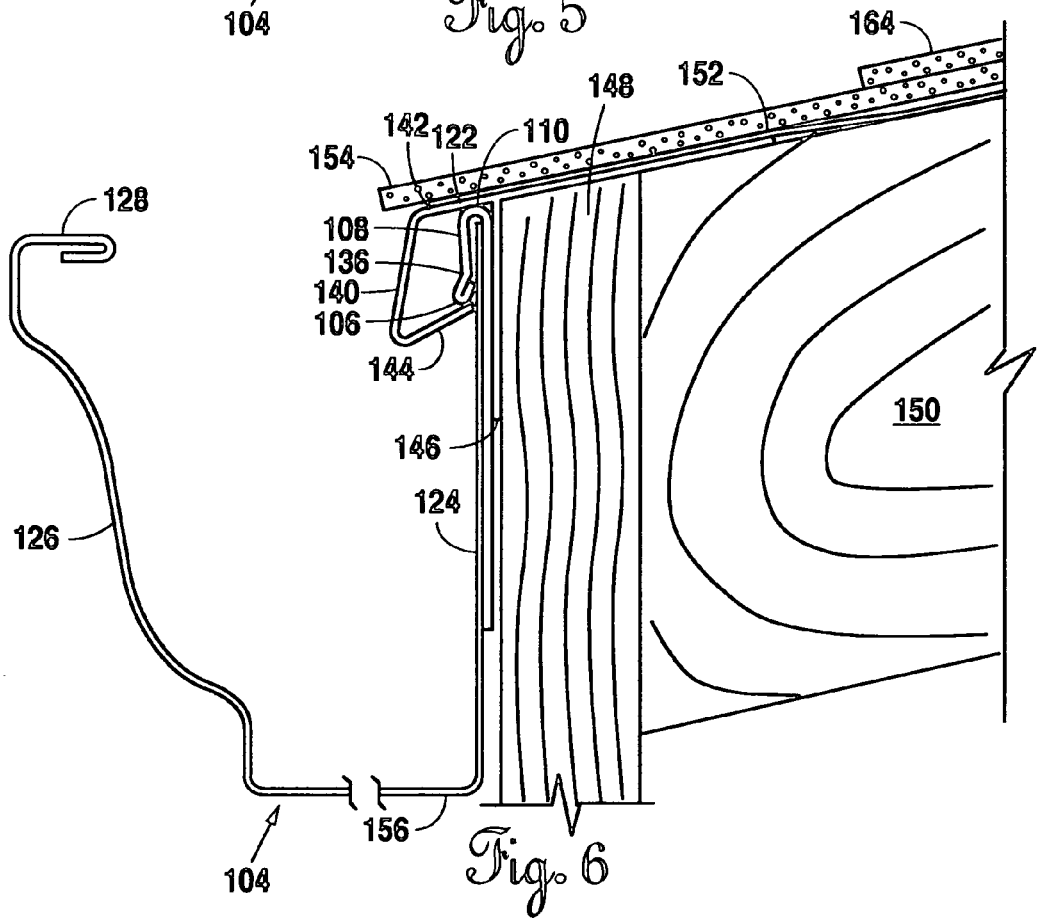
FIG. 6 is a cross-section view of the gutter clip component of the preferred embodiment of the present invention without the L-portion with a gutter and retaining member against a building.

FIG. 6 shows a cross-section view of the gutter clip 102 of FIG. 4A of the preferred embodiment of the present invention without the L-portion 158 (See FIG. 2) with a gutter 104 and retaining member 122 against a building 150. Beginning at the back portion 160 (See FIG. 2) is locking tip 134 which is contiguous into nib end 106. Nib end 106 transitions into hanger 108 via junction 136. Hanger 108 is contiguous with upper u-portion 110. The portion of gutter clip 102 from locking tip 134 to upper u-portion 110 fits inside the back wall 124 of gutter 104. Upper u-portion 110 can be crimped to secure gutter clip 102 snugly to gutter 104.

Front face 120 fits against mounting lip 146 of retaining member 122. Mounting lip 146 ends in horizontal section 142. One end of horizontal section 142 proceeds under the roof 152 tiles 164 while the remaining end drops into a return 140. Return 140 ends in hooked portion 144. Nib end 106 extends slightly beyond the dimensions of hanger 108 and therefore can fit within hooked portion 144 to allow locking tip 134 to secure gutter clip 102 and gutter 104 securely in place. The back of mounting lip 146 presses against building 150. The vertical portion 162 of gutter clip 102 as well as the upper u-portion 110, hanger 108, nib end 106, junction 136 and locking tip 134 of gutter clip 102 are positioned under the eaves 154 of building 150. A portion of horizontal section 142, return 140 and hooked portion 144 of retaining member 122 are positioned under the eaves 154 of building 150 as is gutter 104. Back face 118 (See FIG. 3) fits against the outside of the back wall 124 of gutter 104. Upper u-portion 110 of gutter clip 102 continues into vertical portion 162. The remainder of gutter 104 includes a gutter channel 156, front wall 126 and lip 128.

Figure 7:
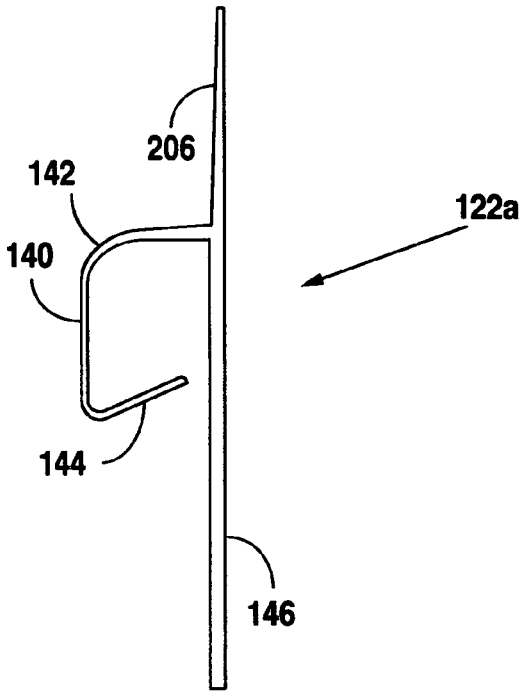
FIG. 7 is a cross-section view of the retaining member of the second embodiment of the present invention.

FIG. 7 is a cross-section view of the retaining member 122*a* of the second embodiment of the present invention. Mounting lip 146 is provided which is contiguous with upper vertical section 206. At the junction between mounting lip 146 and upper vertical section 206 is one end of horizontal section 142. The remainder of horizontal section 142 drops into return. Return 140 ends in hooked portion 144.

Figure 8:
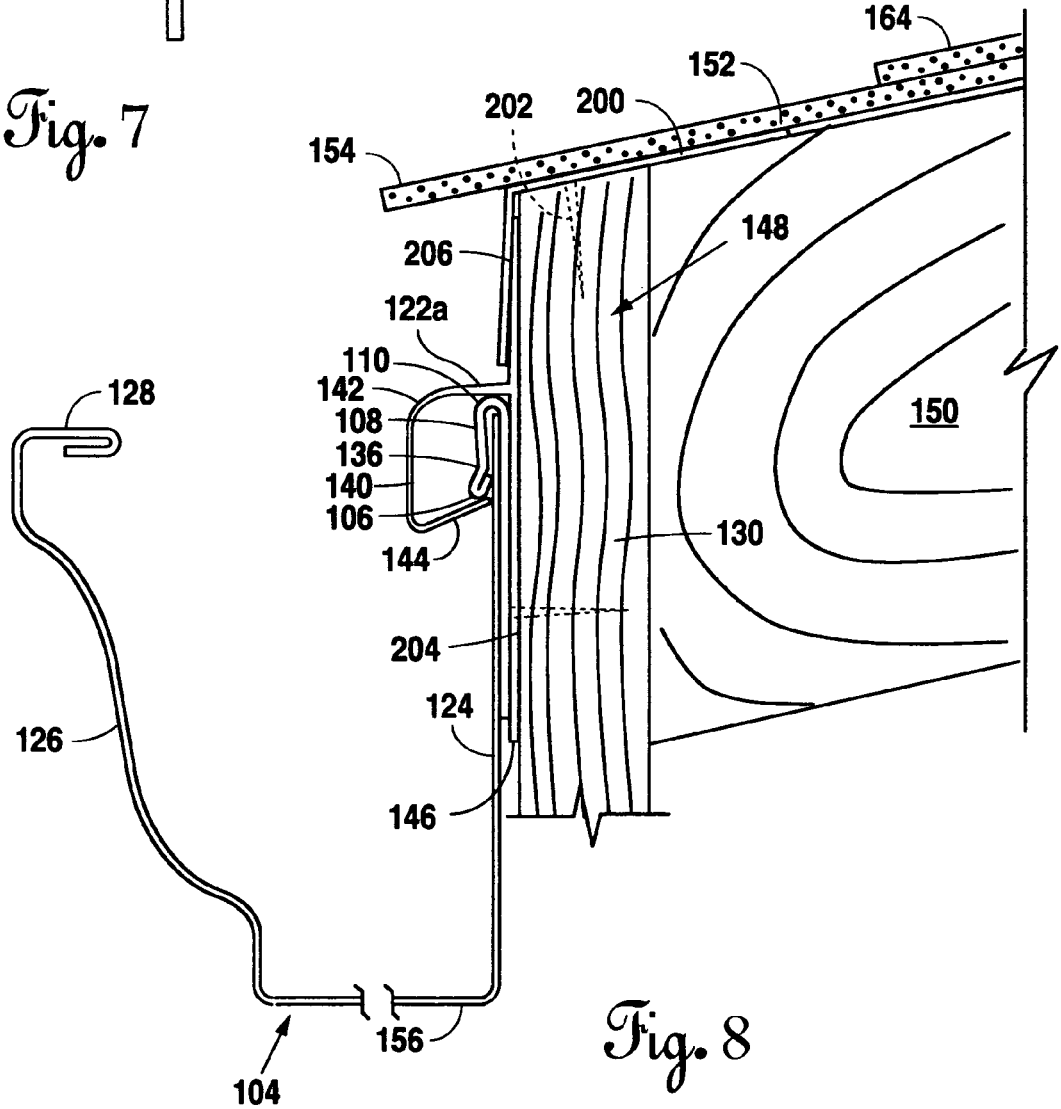
FIG. 8 is a cross-section view of the gutter clip component of the preferred embodiment of the present invention without the L-portion with a gutter and the retaining member of the second embodiment against a building incorporating metal flashing.

FIG. 8 is a cross-section view of the gutter clip component 102 (See FIG. 4A) of the preferred embodiment of the present invention without the L-portion 158 (See FIG. 2) with a gutter 104 and the retaining member 122*a* of the second embodiment against a building 150 incorporating metal flashing 200 held in place with nails 202. Beginning at the back portion 160 (See FIG. 2) is locking tip 134 (See FIG. 5) which is contiguous into nib end 106. Nib end 106 transitions into hanger 108 via junction 136. Hanger 108 is contiguous with upper u-portion 110. The portion of gutter clip 102 from locking tip 134 (See FIG. 5) to upper u-portion 110 fits inside the back wall 124 of gutter 104. Upper u-portion 110 can be crimped to secure gutter clip 102 snugly to gutter 104.

Front face 120 (See FIG. 2) fits against mounting lip 146 of retaining member 122*a*. Mounting lip 146 is contiguous with upper vertical section 206. Upper vertical section 206 is designed to extend in front of or behind metal flashing 200. In addition, upper vertical section 206 can be used when no metal flashing 200 is provided. At the junction between mounting lip 146 and upper vertical section 206 is one end of horizontal section 142. The remainder of horizontal section 142 drops into return 140. Return 140 ends in hooked portion 144. Nib end 106 extends slightly beyond the dimensions of hanger 108 and therefore can fit within hooked portion 144 to allow locking tip 134 (See FIG. 5) to secure gutter clip 102 and gutter 104 securely in place. The back of mounting lip 146 presses against building 150. The vertical portion 162 (See FIG. 4A) of gutter clip 102 as well as the upper u-portion 110, hanger 108, nib end 106, junction 136 and locking tip 134 (See FIG. 5) of gutter clip 102 are positioned under the eaves 154 of building 150. A portion of horizontal section 142, return 140 and hooked portion 144 of retaining member 122 are positioned under the eaves 154 of building 150 as is gutter 104. Back face 118 (See FIG. 3) fits against the outside of the back wall 124 of gutter 104. Upper u-portion 110 of gutter clip 102 continues into vertical portion 162 (See FIG. 4A). The remainder of gutter 104 includes a gutter channel 156, front wall 126 and lip 128.

The second embodiment can also incorporate the gutter clip 102 having the L-portion 158 as shown in FIG. 2. Beginning at the back portion 160 (See FIG. 2) is locking tip 134 which is contiguous into nib end 106. Nib end 106 transitions into hanger 108 via junction 136. Hanger 108 is contiguous with upper u-portion 110. The portion of gutter clip 102 from locking tip 134 (See FIG. 5) to upper u-portion 110 fits inside the back wall 124 of gutter 104. Upper u-portion 110 can be crimped to secure gutter clip 102 snugly to gutter 104.

Front face 120 (See FIG. 2) fits against mounting lip 146 of retaining member 122. Mounting lip 146 is contiguous with upper vertical section 206. At the junction between mounting lip 146 and upper vertical section 206 is one end of horizontal section 142. The remainder of horizontal section 142 drops into return 140. Return 140 ends in hooked portion 144. Nib end 106 extends slightly beyond the dimensions of hanger 108 and therefore can fit within hooked portion 144 to allow locking tip 134 (See FIG. 5) to secure gutter clip 102 and gutter 104 in place. The back of mounting lip 146 presses against a building 150. The thickness of L-portion 158 (See FIG. 2) allows for base extension 130 to fit properly against building 150. L-portion 158 (See FIG. 2) provides stability to gutter 104 to prevent gutter 104 from sagging towards building 150. The vertical portion 162 (See FIG. 2) of gutter clip 102 as well as the upper u-portion 110, hanger 108, nib end 106, junction 136 and locking tip 134 (See FIG. 5) of gutter clip 102 are positioned adjacent building 150. A portion of horizontal section 142, return 140 and hooked portion 144 of retaining member 122 are adjacent building 150 as is gutter 104.

Back face 118 (See FIG. 3) fits against the outside of the back wall 124 of gutter 104 from upper u-portion 110 to first elbow 112 (See FIG. 3). Upper u-portion 110 of gutter clip 102 continues into vertical portion 162 (See FIG. 2). Vertical portion 162 (See FIG. 2) transitions into L-portion 158 (See FIG. 2) which begins at first elbow 112 (See FIG. 3). First elbow 112 (See FIG. 3) turns into base 114 (See FIG. 3) which proceeds into second elbow 116 (See FIG. 3). Second elbow 116 (See FIG. 3) turns up into base extension 130 (See FIG. 3). Base extension 130 (See FIG. 3) is designed to fit against building 150. Base extension 130 (See FIG. 3) is contiguous with lower u-portion 132 (See FIG. 3), lower u-portion 132 (See FIG. 3) being completed at end 138 (See FIG. 3). The remainder of gutter 104 includes a gutter channel 156, front wall 126 and lip 128.

Figure 9:
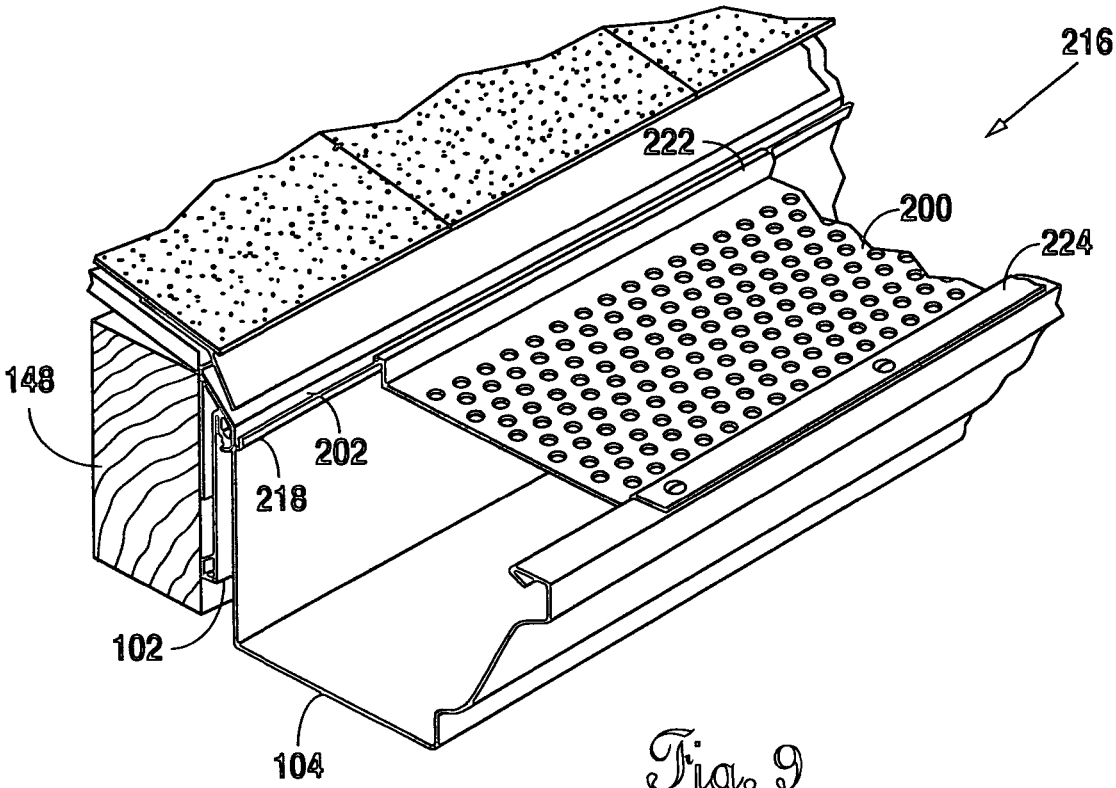
FIG. 9 is a perspective view of the preferred embodiment of the present invention incorporating the gutter clip component, a debris guard, and retaining member of the third embodiment of the present invention utilizing a back snap in debris guard.

FIG. 9 is a perspective view of the preferred embodiment of the present invention incorporating the gutter clip 102, a back-snap-in debris guard 200, and retaining member of the third embodiment 202 of the present invention. Gutter clip 102, gutter 104 and retaining member 202 make up a gutter retaining system 216. Retaining member 202 has an upward facing lip 218 shown in more detail in FIG. 11. This upward facing lip 218 is designed to receive a mating downward facing lip 220 (See FIG. 11) from one side 222 of a back-snap-in debris guard 200. Once back-snap-in debris guard 200 is mated to upward facing lip 218 of retaining member 202, the opposing side 224 can be mounted to the front of gutter 104. Gutter 104 remains free floating even with the back-snap-in debris guard 200 installed.

Figure 10:
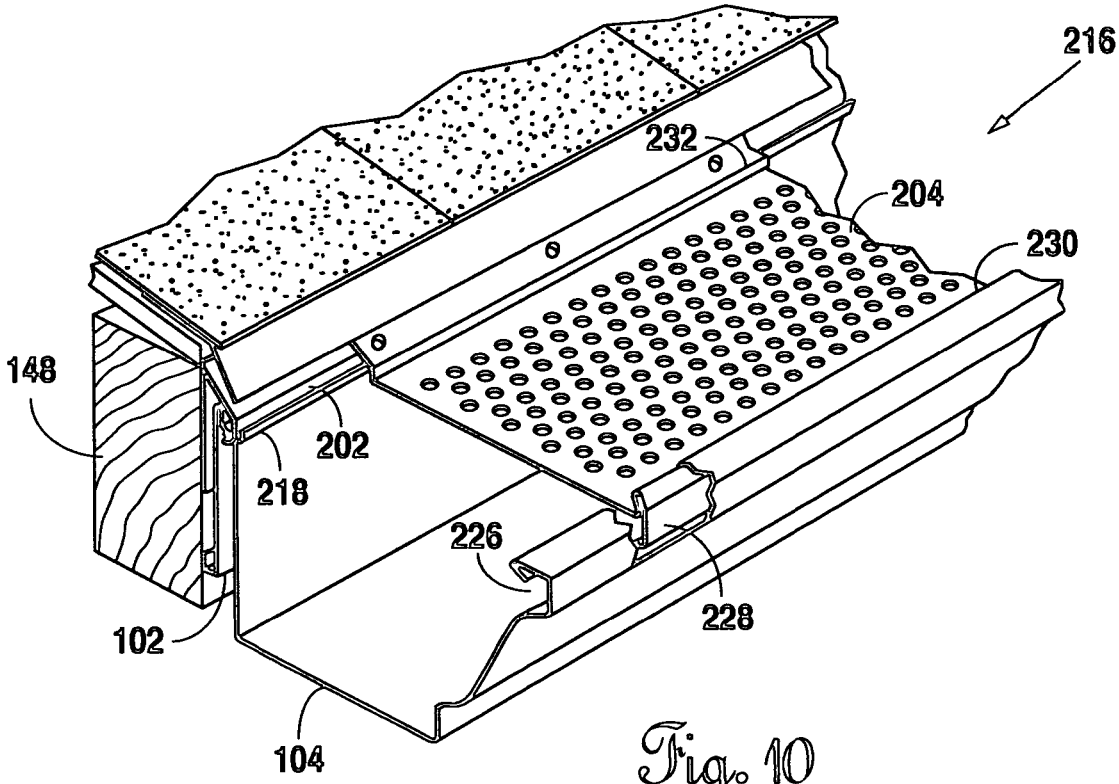
FIG. 10 is a perspective view of the preferred embodiment of the present invention incorporating the gutter clip component, a debris guard, and retaining member of the third embodiment of the present invention utilizing a front snap in debris guard.

FIG. 10 is a perspective view of the preferred embodiment of the present invention incorporating the gutter clip 102, a front-snap-in debris guard 204, and retaining member of the third embodiment 202 of the present invention. Gutter clip 102, gutter 104 and retaining member 202 make up gutter retaining system 216. At the front of gutter 104 is a receiving component 226. This receiving component 226 is designed to receive a mating piece 228 from one side 230 of front-snap-in debris guard 204. Once front-snap-in debris guard 204 is mated to receiving component 226 of gutter 104, the opposing side 232 can be mounted to the retaining member 202. Gutter 104 remains free floating even with the front-snap-in debris guard 204 installed.

Figure 11:
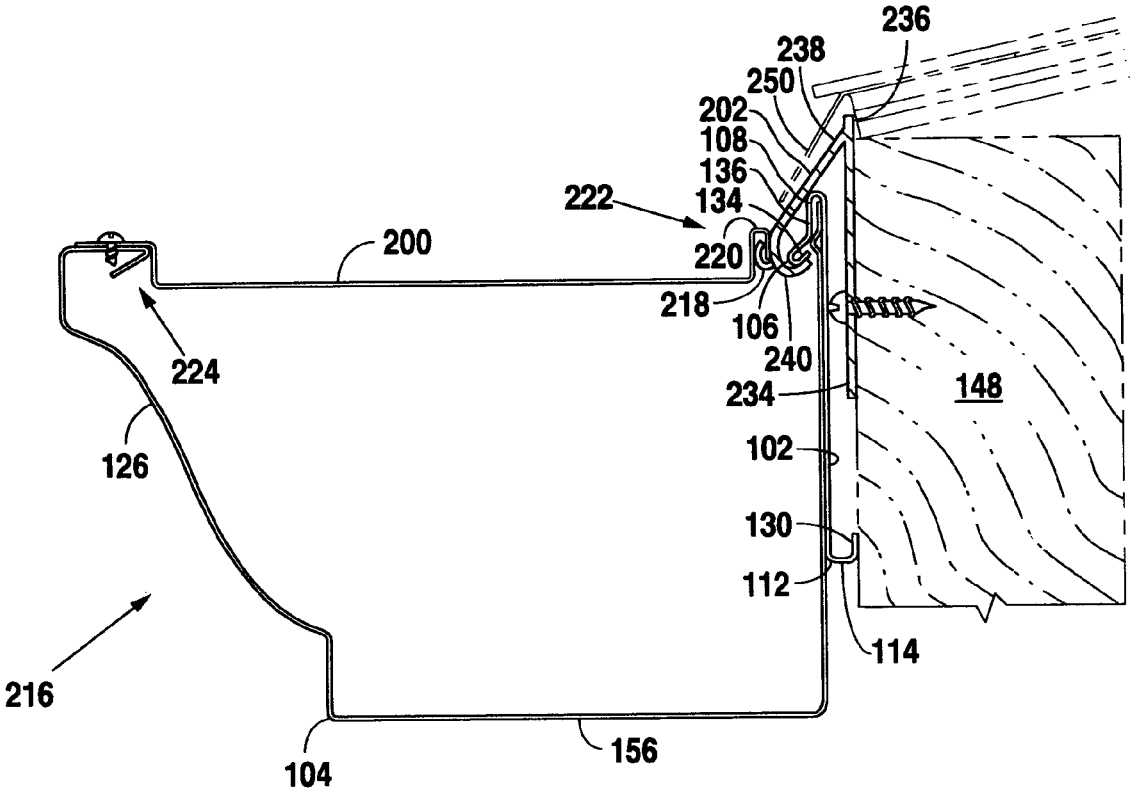
FIG. 11 is a cross-section view of the preferred embodiment of the present invention incorporating the gutter clip component, a debris guard, and retaining member of the third embodiment of the present invention utilizing a back snap in debris guard.

FIG. 11 is a cross-section view of the preferred embodiment of the present invention incorporating the gutter clip 102, a back-snap-in debris guard 200, and retaining member of the third embodiment 202 of the present invention. Gutter clip 102, gutter 104 and retaining member 202 make up a gutter retaining system 216. Gutter clip 102 is essentially L-shaped incorporating an L portion 158 (See FIG. 2), a back portion 160 (See FIG. 2), a front face 120 (See FIG. 2) and a back face 118 (See FIG. 2). Starting at the back portion 160 (See FIG. 2) is locking tip 134 which is adjacent nib end 106. Nib end 106 transitions into hanger 108 via junction 136. Hanger 108 continues into upper u-portion 110 (See FIG. 2). The portion of gutter clip 102 from locking tip 134 to upper u-portion 110 (See FIG. 2) fits inside the back wall 124 of gutter 104. Upper u-portion 110 (See FIG. 2) can be crimped to secure gutter clip 102 snugly to gutter 104. Back face 118 (See FIG. 2) fits against the outside of the back wall 124 of gutter 104 from upper u-portion 110 (See FIG. 2) to first elbow 112. Upper u-portion 110 (See FIG. 2) of gutter clip 102 continues into vertical portion 162 (See FIG. 2). Vertical portion 162 transitions into L-portion 158 (See FIG. 2) which begins at first elbow 112. First elbow 112 turns into base 114 which proceeds into second elbow 116. Second elbow 116 turns up into base extension 130. The remainder of gutter 104 includes a gutter channel 156 and front wall 126.

Retaining member 202 has vertical portion 234 designed to fit against building 150. Vertical portion 234 is contiguous with an upper portion 236 of retaining member 202. Angled downward from upper portion 236 is angled member 238. Angled member 238 drops into a hooked portion 240. Hooked portion 240 faces building 150. Attached to and extending away from hooked portion is upward facing lip 218.

This upward facing lip 218 is designed to receive a mating downward facing lip 220 from one side 222 of a back-snap-in debris guard 200. Once back-snap-in debris guard 200 is mated to upward facing lip 218 of retaining member 202, the opposing side 224 of debris guard 200 can be mounted to the front wall 126 of gutter 104. Gutter 104 remains free floating even with the back-snap-in debris guard 200 installed.

Figure 12:
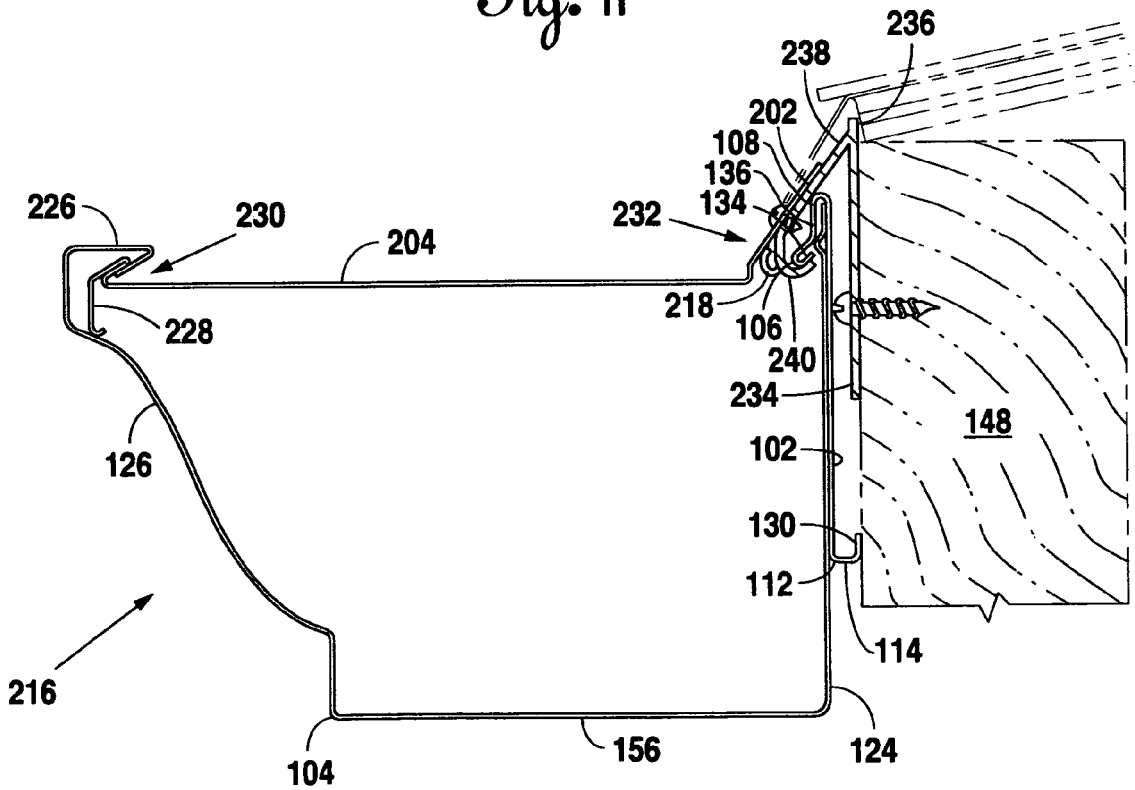
FIG. 12 is a cross-section view of the preferred embodiment of the present invention incorporating the gutter clip component, a debris guard, and retaining member of the third embodiment of the present invention utilizing a front snap in debris guard.

FIG. 12 is a cross-section view of the preferred embodiment of the present invention incorporating the gutter clip 102, a front-snap-in debris guard 204, and retaining member of the third embodiment 202 of the present invention. Gutter clip 102, gutter 104 and retaining member 202 make up gutter retaining system 216. Gutter clip 102 is essentially L-shaped incorporating an L portion 158 (See FIG. 2), a back portion 160 (See FIG. 2), a front face 120 (See FIG. 2) and a back face 118 (See FIG. 2). Starting at the back portion 160 (See FIG. 2) is locking tip 134 which is adjacent nib end 106. Nib end 106 transitions into hanger 108 via junction 136. Hanger 108 continues into upper u-portion 110 (See FIG. 2). The portion of gutter clip 102 from locking tip 134 to upper u-portion 110 (See FIG. 2) fits inside the back wall 124 of gutter 104. Upper u-portion 110 (See FIG. 2) can be crimped to secure gutter clip 102 snugly to gutter 104. Back face 118 (See FIG. 2) fits against the outside of the back wall 124 of gutter 104 from upper u-portion 110 (See FIG. 2) to first elbow 112. Upper u-portion 110 (See FIG. 2) of gutter clip 102 continues into vertical portion 162 (See FIG. 2). Vertical portion 162 transitions into L-portion 158 (See FIG. 2) which begins at first elbow 112. First elbow 112 turns into base 114 which proceeds into second elbow 116. Second elbow 116 turns up into base extension 130. The remainder of gutter 104 includes a gutter channel 156 and front wall 126.

Retaining member 202 has vertical portion 234 designed to fit against building 150. Vertical portion 234 is contiguous with an upper portion 236 of retaining member 202. Angled downward from upper portion 236 is angled member 238. Angled member 238 drops into a hooked portion 240. Hooked portion 240 faces building 150. Attached to and extending away from hooked portion is upward facing lip 218.

At the front of gutter 104 is a receiving component 226. This receiving component 226 is designed to receive a mating piece 228 from one side 230 of front-snap-in debris guard 204. Once front-snap-in debris guard 204 is mated to receiving component 226 of gutter 104, the opposing side 232 of debris guard 204 can be mounted to the angled member 238 of retaining member 202. Gutter 104 remains free floating even with the front-snap-in debris guard 204 installed.

Figure 13A:
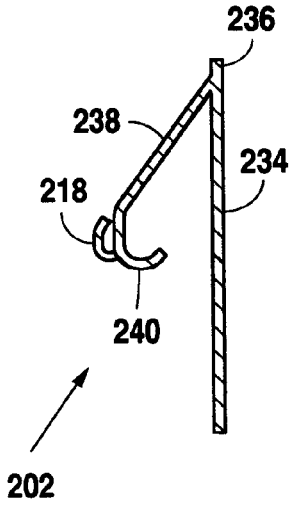
FIG. 13A is a cross-section view of the retaining member of the third embodiment of the present invention.

FIG. 13A is a cross-section view of the retaining member of the third embodiment 202 of the present invention. Retaining member 202 has vertical portion 234 designed to fit against building 150 (See FIG. 11). Vertical portion 234 is contiguous with an upper portion 236 of retaining member 202. Angled downward from upper portion 236 is angled member 238. Angled member 238 drops into a hooked portion 240. Hooked portion 240 is designed to face building 150 (See FIG. 11). Attached to and extending away from hooked portion 240 is upward facing lip 218.

Figure 14A:
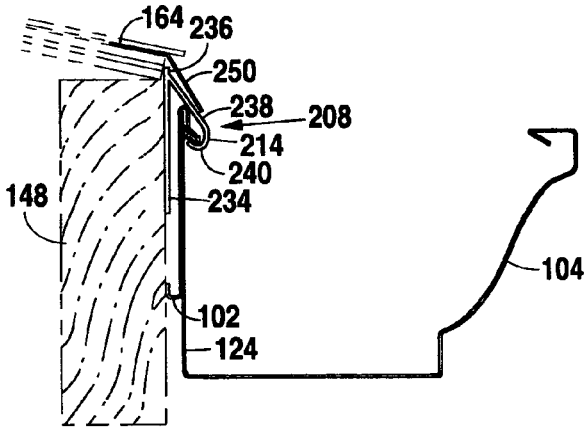
FIG. 14A is a cross-section view of the preferred embodiment of the present invention incorporating the gutter clip component and retaining member of the eighth embodiment of the present invention.

This retaining member 202 is designed for use with roofing systems having straight fascia 148 (See FIG. 14A) with preferably an adjacent drip edge 250 (See FIG. 14A). Horizontal portion of retaining member 202 is placed against fascia board 148 (See FIG. 14A). When a drip edge 250 (See FIG. 14A) is present over fascia 148 (See FIG. 14A), retaining member 202 is pushed under the drip edge 250 (See FIG. 14A) to create a water tight seal. When a drip edge 250 (See FIG. 14A) is not present, retaining member 202) is mounted at the top of fascia 148 (See FIG. 14A) under roof tile or shingle 164 (See FIG. 14A). Upward facing lip 218 adjacent hooked portion 240 is designed to receive a mating downward facing lip 220 (See FIG. 11) from one side 222 (See FIG. 11) of a back-snap-in debris guard 200 (See FIG. 11).

Figure 13B:
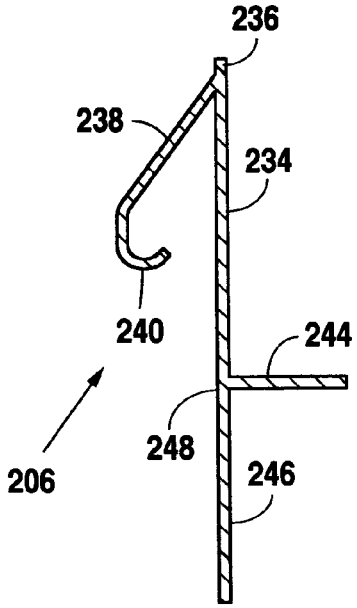
FIG. 13B is a cross-section view of the retaining member of the fourth embodiment of the present invention.

FIG. 13B is a cross-section view of the retaining member of the fourth embodiment 206 of the present invention. Vertical portion 234 is contiguous with an upper portion 236 of retaining member 206. Angled downward from upper portion 236 is angled member 238. Angled member 238 drops into a hooked portion 240. Hooked portion 240 is designed to face building 150 (See FIG. 11). Extending at a right angle from a point 248 along vertical portion 234 is base 244. Extending below point 248 along vertical portion 234 is extension 246.

This retaining member 206 is designed for use with roofing systems having slanted fascia 148 (See FIG. 14C) with preferably an adjacent drip edge 250 (See FIG. 11). The fascia 148 (See FIG. 14C) is slanted from about 5 to 30 degrees. The purpose of this design is to support the back wall 124 of gutter 104 so the back wall 124 of gutter 104 remains vertical and does not allow the gutter 104 to follow the slant or angle of the fascia 148 (See FIG. 14C). The retaining member 206 and the back wall 124 of gutter 104 are flush after installation. Vertical portion 234 of retaining member 206 is placed in front of the fascia 148 (See FIG. 14C). When a drip edge 250 (See FIG. 14C) is present, angled member 238 of retaining member 206 fits under the drip edge 250 (See FIG. 14C). When a drip edge 250 (See FIG. 14C) is not present, retaining member 206 covers fascia 148 (See FIG. 14C) directly under the roof tiles or shingles 164 (See FIG. 14C).

Figure 13C:
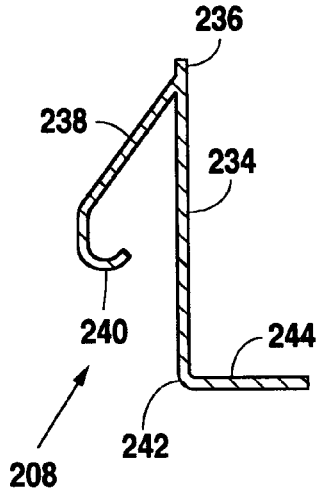
FIG. 13C is a cross-section view of the retaining member of the fifth embodiment of the present invention.

FIG. 13C is a cross-section view of the retaining member of the fifth embodiment 208 of the present invention. Retaining member 208 has vertical portion 234 designed to fit against building 150 (See FIG. 11). Vertical portion 234 is contiguous with an upper portion 236 and a lower portion 242 of retaining member 208. Angled downward from upper portion 236 is angled member 238. Angled member 238 drops into a hooked portion 240. Hooked portion 240 is designed to face building 150 (See FIG. 11). Extending at a right angle from lower portion 242 is base 244.

Figure 14B:
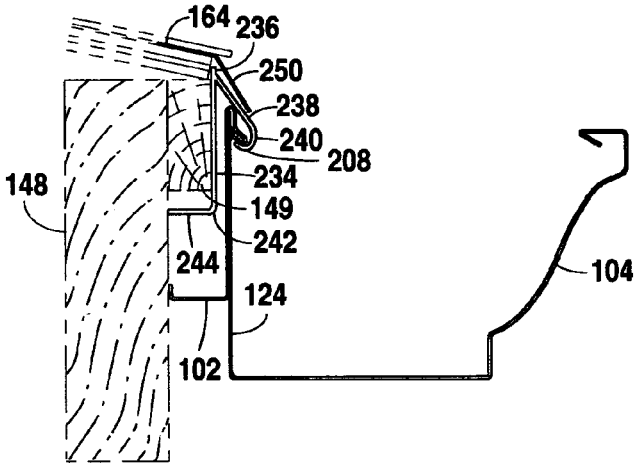
FIG. 14B is a cross-section view of the preferred embodiment of the present invention incorporating the gutter clip component and retaining member of the fifth embodiment of the present invention.

This retaining member 208 is designed for use with roofing systems having trim board 149 (See FIG. 14B) next to fascia 148 (See FIG. 14B) with preferably an adjacent drip edge 250 (See FIG. 14B). Vertical portion 234 of retaining member 208 is placed in front of the trim board 149 (See FIG. 14B). When a drip edge 250 (See FIG. 14B) is present over trim board 149 (See FIG. 14B), angled member 238 of retaining member 208 fits under the drip edge 250 (See FIG. 14B). When a drip edge 250 (See FIG. 14B) is not present, retaining member 208 covers trim board 149 (See FIG. 14B) directly under the roof tiles or shingles 164 (See FIG. 14B).

Figure 13D:
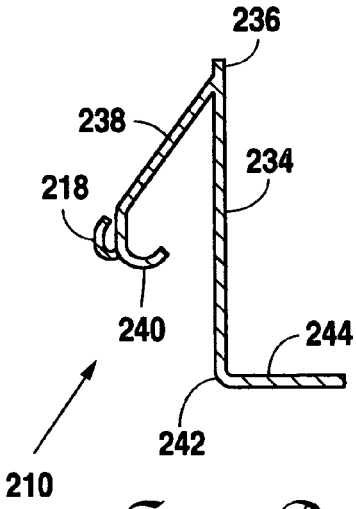
FIG. 13D is a cross-section view of the retaining member of the sixth embodiment of the present invention.

FIG. 13D is a cross-section view of the retaining member of the sixth embodiment 210 of the present invention. Retaining member 210 has vertical portion 234 designed to fit against building 150 (See FIG. 11). Vertical portion 234 is contiguous with an upper portion 236 and lower portion 242 of retaining member 210. Angled downward from upper portion 236 is angled member 238. Angled member 238 drops into a hooked portion 240. Hooked portion 240 is designed to face building 150 (See FIG. 11). Attached to and extending away from hooked portion 240 is upward facing lip 218. Extending at a right angle from lower portion 242 is base 244.

This retaining member 210 is designed for use with roofing systems having trim board 149 (See FIG. 14B) next to fascia 148 (See FIG. 14B) with preferably an adjacent drip edge 250 (See FIG. 14B). Vertical portion 234 of retaining member 210 is placed in front of the trim board 149 (See FIG. 14B). When a drip edge 250 (See FIG. 14B) is present over trim board 149 (See FIG. 14B), angled member 238 of retaining member 210 fits under the drip edge 250 (See FIG. 14B). When a drip edge 250 (See FIG. 14B) is not present, retaining member 210 covers trim board 149 (See FIG. 14B) directly under the roof tiles or shingles 164 (See FIG. 14B). Upward facing lip 218 adjacent hooked portion 240 is designed to receive a mating downward facing lip 220 (See FIG. 11) from one side 222 (See FIG. 11) of a back-snap-in debris guard 200 (See FIG. 11).

Figure 13E:
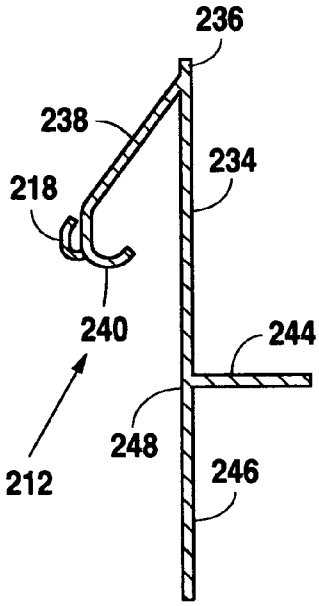
FIG. 13E is a cross-section view of the retaining member of the seventh embodiment of the present invention.

FIG. 13E is a cross-section view of the retaining member of the seventh embodiment 212 of the present invention. Retaining member 212 has vertical portion 234 designed to fit against building 150 (See FIG. 11). Vertical portion 234 is contiguous with an upper portion 236 of retaining member 212. Angled downward from upper portion 236 is angled member 238. Angled member 238 drops into a hooked portion 240. Hooked portion 240 is designed to face building 150 (See FIG. 11). Attached to and extending away from hooked portion 240 is upward facing lip 218. Extending at a right angle from a point 248 along vertical portion 234 is base 244. Extending below point 248 along vertical portion 234 is extension 246.

Figure 14C:
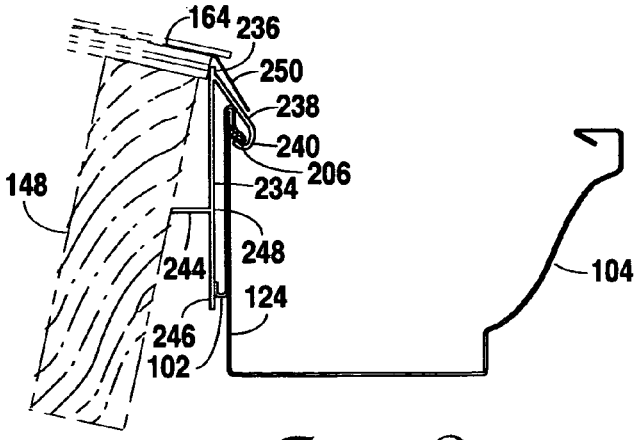
FIG. 14C is a cross-section view of the preferred embodiment of the present invention incorporating the gutter clip component and retaining member of the fourth embodiment of the present invention.

This retaining member 212 is designed for use with roofing systems having slanted fascia 148 (See FIG. 14C) with preferably an adjacent drip edge 250 (See FIG. 14C). The fascia 148 (See FIG. 14C) is slanted from about 5 to 30 degrees. The purpose of this design is to support the back wall 124 of gutter 104 so the back wall 124 of gutter 104 remains vertical and does not allow the gutter 104 to follow the slant or angle of the fascia 148 (See FIG. 14C). The retaining member 212 and the back wall 124 of gutter 104 are flush after installation. Vertical portion 234 of retaining member 212 would be placed in front of the fascia 148 (See FIG. 14C). When a drip edge 250 (See FIG. 14C) is present, angled member 238 of retaining member 212 fits under the drip edge 250 (See FIG. 14C). When a drip edge 250 (See FIG. 14C) is not present, retaining member 212 covers fascia 148 (See FIG. 14C) directly under the roof tiles or shingles 164 (See FIG. 14C). Upward facing lip 218 adjacent hooked portion 240 is designed to receive a mating downward facing lip 220 (See FIG. 11) from one side 222 (See FIG. 11) of a back-snap-in debris guard 200 (See FIG. 11).

Figure 13F:
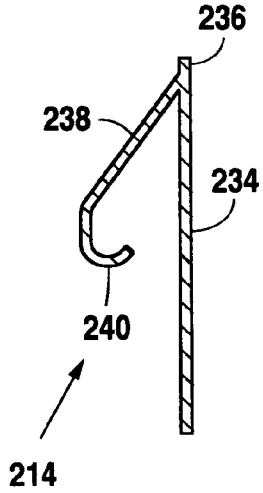
FIG. 13F is a cross-section view of the retaining member of the eighth embodiment of the present invention.

FIG. 13F is a cross-section view of the retaining member 214 of the eighth embodiment of the present invention. Retaining member 214 has vertical portion 234 designed to fit against building 150 (See FIG. 11). Vertical portion 234 is contiguous with an upper portion 236 of retaining member 214. Angled downward from upper portion 236 is angled member 238. Angled member 238 drops into a hooked portion 240. Hooked portion 240 is designed to face building 150 (See FIG. 11).

This retaining member 214 is designed for use with roofing systems having straight fascia 148 (See FIG. 14A) with preferably an adjacent drip edge 250 (See FIG. 14A). Horizontal portion of retaining member 214 would be placed against fascia board 148 (See FIG. 14A). When a drip edge 250 (See FIG. 14A) is present over fascia 148 (See FIG. 14A), retaining member 214 is pushed under the drip edge 250 (See FIG. 14A) to create a water tight seal. When a drip edge 250 (See FIG. 14A) is not present, retaining member 214 is mounted at the top of fascia 148 (See FIG. 14A) under roof tile or shingle 164 (See FIG. 14A).

FIG. 14A is a cross-section view of the preferred embodiment of the present invention incorporating the gutter clip 102 and retaining member of the eighth embodiment 214 of the present invention. Gutter clip 102 is essentially L-shaped incorporating an L-portion 158 (See FIG. 2), a back portion 160 (See FIG. 2), a front face 120 (See FIG. 2) and a back face 118 (See FIG. 2). Back face 118 (See FIG. 2) sits against the outside of back wall 124 of gutter 104. In this embodiment the L-portion 158 (See FIG. 2) sits against fascia board 148.

Retaining member 214 has vertical portion 234 designed to fit against fascia 148. Vertical portion 234 is contiguous with an upper portion 236 of retaining member 214. Angled downward from upper portion 236 is angled member 238.

Angled member 238 drops into a hooked portion 240. Hooked portion 240 faces fascia board 148.

FIG. 14B is a cross-section view of the preferred embodiment of the present invention incorporating the gutter clip 102 and retaining member of the fifth embodiment 208 of the present invention. Gutter clip 102 is essentially L-shaped incorporating an L-portion 158 (See FIG. 2), a back portion 160 (See FIG. 2), a front face 120 (See FIG. 2) and a back face 118 (See FIG. 2). Back face 118 (See FIG. 2) sits against the outside of back wall 124 of gutter 104. In this embodiment the L-portion 158 (See FIG. 2) is a little longer than that of FIG. 14A so as to permit it to sit against fascia board 148.

Retaining member 208 has vertical portion 234 designed to fit against trim board 149. Vertical portion 234 is contiguous with an upper portion 236 and a lower portion 242 of retaining member 208. Angled downward from upper portion 236 is angled member 238. Angled member 238 drops into hooked portion 240. Hooked portion 240 is designed to face trim board 149. Extending at a right angle from lower portion 242 is base 244.

This retaining member 208 is designed for use with roofing systems having trim board 149 next to fascia board 148 with preferably an adjacent drip edge 250. Vertical portion 234 of retaining member 208 is placed in front of trim board 149. When a drip edge 250 is present over trim board 149, angled member 238 of retaining member 208 fits under drip edge 250. When a drip edge 250 is not present, retaining member 208 covers trim board 149 directly under the roof tiles or shingles 164.

FIG. 14C is a cross-section view of the preferred embodiment of the present invention incorporating the gutter clip 102 and retaining member of the fourth embodiment 206 of the present invention. Gutter clip 102 is essentially L-shaped incorporating an L-portion 158 (See FIG. 2), a back portion 160 (See FIG. 2), a front face 120 (See FIG. 2) and a back face 118 (See FIG. 2). Back face 118 (See FIG. 2) sits against the outside of back wall 124 of gutter 104. In this embodiment the L-portion 158 (See FIG. 2) sits against extension 246 of retaining member 206.

Vertical portion 234 of retaining member 206 is contiguous with an upper portion 236 of retaining member 206. Angled downward from upper portion 236 is angled member 238. Angled member 238 drops into hooked portion 240. Hooked portion 240 is designed to face fascia 148. Extending at a right angle from a point 248 along vertical portion 234 is base 244. Extending below point 248 along vertical portion 234 is extension 246.

This retaining member 206 is designed for use with roofing systems having slanted fascia 148 with preferably an adjacent drip edge 250. The fascia 148 is slanted from about 5 to 30 degrees. The purpose of this design is to support the back wall 124 of gutter 104 so the back wall 124 of gutter 104 remains vertical and does not allow the gutter 104 to follow the slant or angle of the fascia 148. The retaining member 206 and the back wall 124 of gutter 104 are flush after installation. Vertical portion 234 of retaining member 206 is placed in front of fascia 148. When a drip edge 250 is present, angled member 238 of retaining member 206 fits under the drip edge 250. When a drip edge 250 is not present, retaining member 206 covers fascia 148 directly under the roof tiles or shingles 164.

Figure 15:
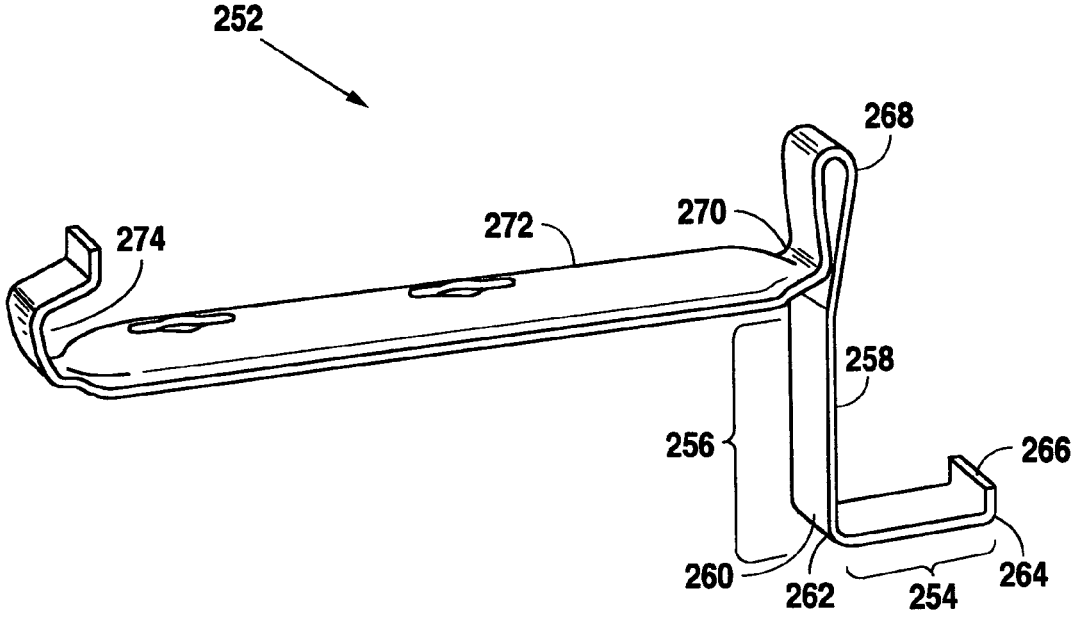
FIG. 15 is a perspective view of the modified gutter clip of the ninth embodiment of the present invention.

FIG. 15 is a perspective view of the modified gutter clip 252 of the ninth embodiment of the present invention. Modified gutter clip 252 is essentially L-shaped incorporating an L-portion 254, a back portion 256, a front face 258, and a back face 260. Back portion 256 transitions into L-portion 254 at one end at elbow 262. Scoring can be used on first elbow 262 to allow L-portion 254 to be easily separated from back portion 256. At the opposite end of L-portion 254 is a second elbow 264 which turns up into extension 266. Back portion 256 at its opposite end transitions into one side of u-portion 268. The other side of u-portion 268 drops into hanger elbow 270. Hanger elbow is contiguous with hanger 272. Hanger 272 ends in hanger lip 274. Hanger 272 is essentially a horizontal section which spans the width of the gutter from hanger elbow 272 to hanger lip 274.

Figure 16:
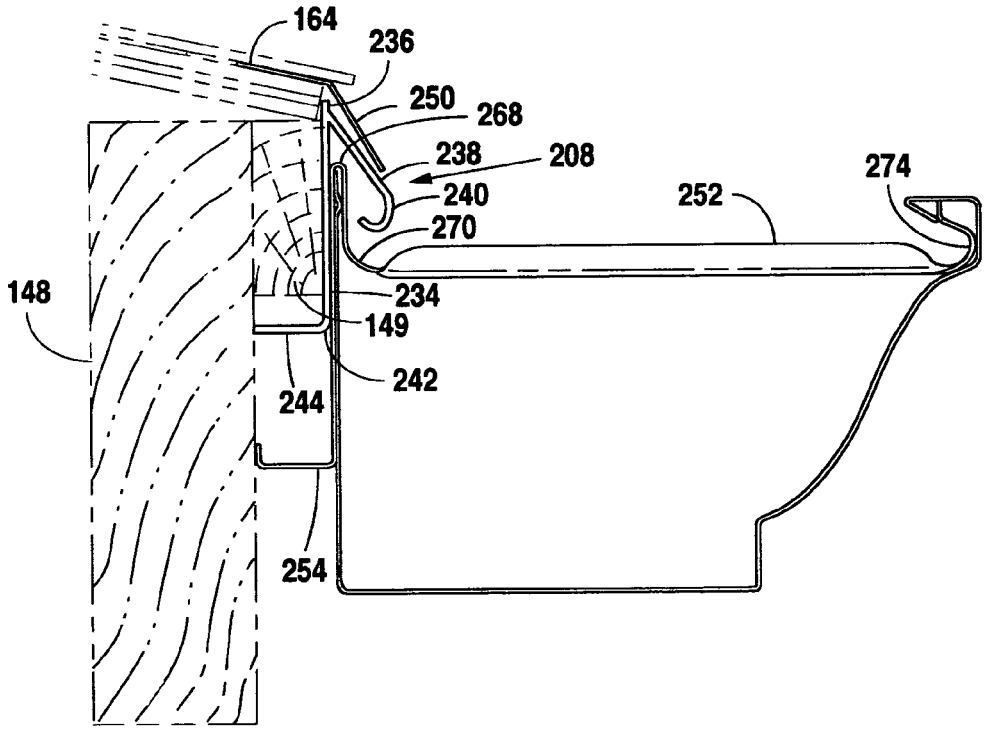
FIG. 16 is a cross section view of the preferred embodiment of the present invention incorporating the modified gutter clip component and a retaining member of the fifth embodiment of the present invention.

FIG. 16 is a cross section view of the preferred embodiment of the present invention incorporating the modified gutter clip component 252 and a retaining member of the fifth embodiment 208 of the present invention. Modified gutter clip 252 is essentially L-shaped having an L-portion 254. Back portion 256 at its opposite end transitions into one side of u-portion 268. The other side of u-portion 268 drops into hanger elbow 270. Hanger elbow 270 is contiguous with hanger 272. Hanger 272 ends in hanger lip 274.

Retaining member 208 has vertical portion 234 designed to fit against trim board 149. Vertical portion 234 is contiguous with an upper portion 236 and a lower portion 242 of retaining member 208. Angled downward from upper portion 236 is angled member 238. Angled member 238 drops into hooked portion 240. Hooked portion 240 is designed to face trim board 149. Extending at a right angle from lower portion 242 is base 244.

This retaining member 208 is designed for use with roofing systems having trim board 149 next to fascia board 148 with preferably an adjacent drip edge 250. Vertical portion 234 of retaining member 208 is placed in front of trim board 149. When a drip edge 250 is present over trim board 149, angled member 238 of retaining member 208 fits under drip edge 250. When a drip edge 250 is not present, retaining member 208 covers trim board 149 directly under the roof tiles or shingles 164.

Figure 17:
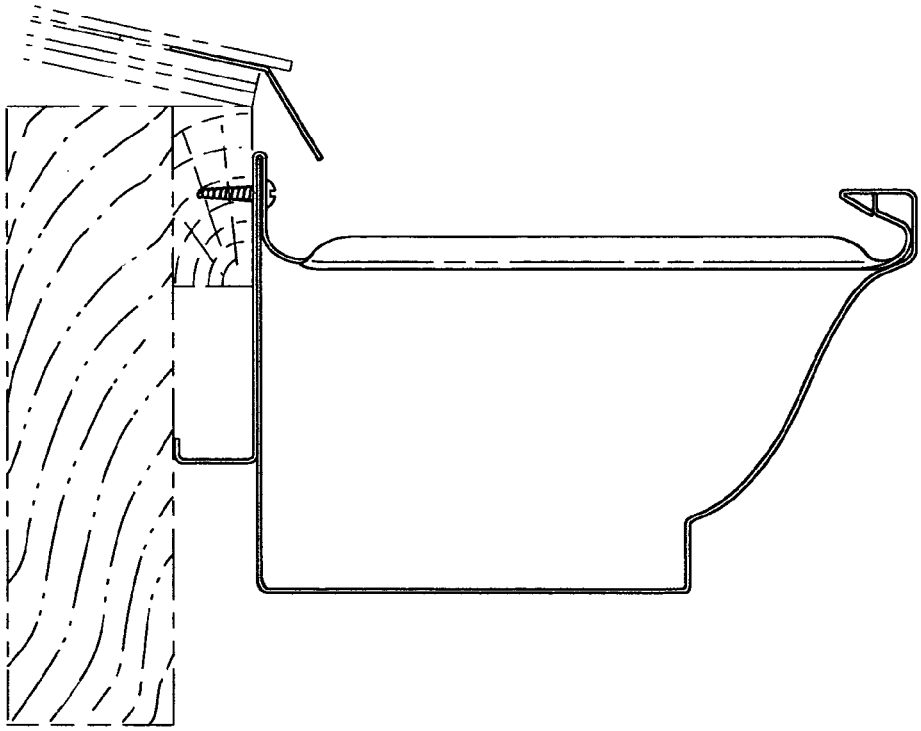
FIG. 17 is a cross section view of the preferred embodiment of the present invention incorporating the modified clip component without the retaining member of the fifth embodiment of the present invention on straight fascia.
Figure 18:
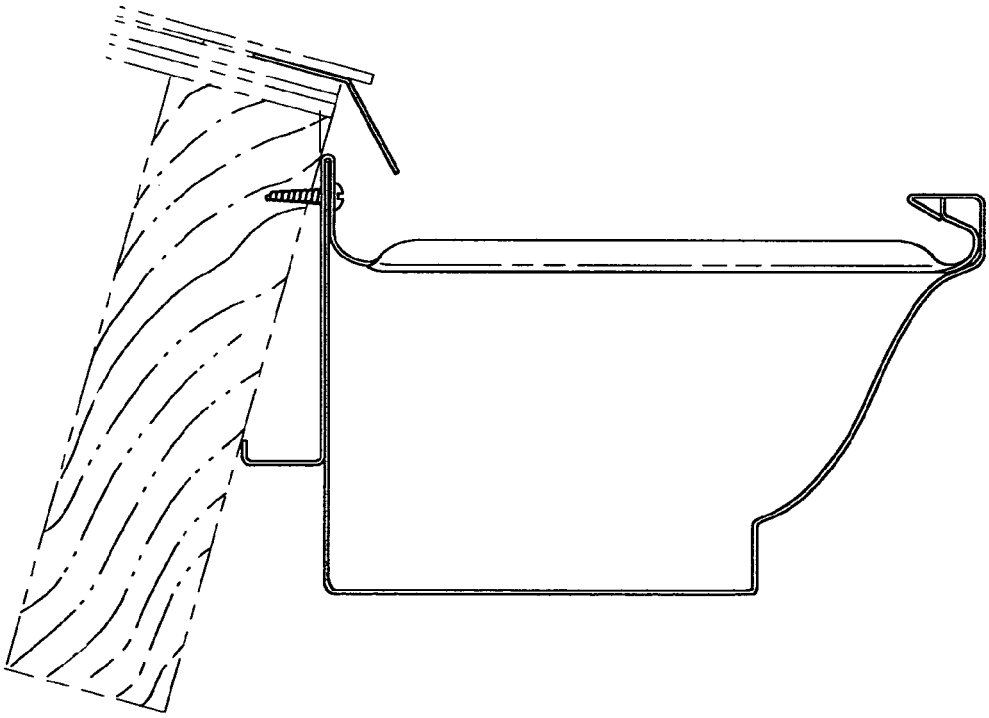
FIG. 18 is a cross section view of the preferred embodiment of the present invention incorporating the modified clip component without the retaining member of the fifth embodiment of the present invention on slanted fascia.

FIG. 17 shows a cross section view of the preferred embodiment of the present invention incorporating the modified clip component without the retaining member of the fifth embodiment of the present invention on straight fascia while FIG. 18 shows the same cross section with slanted fascia.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A gutter retaining system for mounting a rain gutter to a building comprising:

a retaining member;

a gutter having a front wall, a bottom wall adjacent said front wall and a back wall adjacent said bottom wall, said back wall having an interior surface, an outer surface and a top edge; and a gutter clip adjacent said retaining member, wherein said gutter clip has a hanger lip contiguous with a horizontal section, said horizontal section being adjacent a hanger portion, said hanger portion being contiguous with a u-portion, said u-portion being adjacent a vertical portion, said hanger portion and said vertical portion being approximately parallels, with said horizontal section angled outwardly from said hanger portion and extending across the width of said gutter, said hanger lip, said hanger portion and said horizontal section fitting within said gutter, said hanger portion being disposed substantially adjacent said interior surface of said back wall of said gutter, said u-portion receiving said top edge of said back wall, and said vertical portion being disposed adjacent said outer surface of said back wall of said gutter.

2. The gutter retaining system for mounting a rain gutter to a building of claim 1 wherein said retaining member comprises a vertical portion contiguous with an upper portion;

an angled member angled downward from said upper portion; and a hooked portion positioned at the end of said angled member.

3. The gutter retaining system for mounting a rain gutter to a building of claim 2 further comprising a base extending at an angle from said vertical portion of said retaining member.

4. The gutter retaining system for mounting a rain gutter to a building of claim 2 further comprising an upward facing lip attached to said hooked portion of said retaining member.

5. The gutter retaining system for mounting a rain gutter to a building of claim 1 further comprising a base adjacent said vertical portion of said gutter clip, said base extending outward from said vertical portion, away from said outer surface of said back wall of said gutter.

6. The gutter retaining system for mounting a rain gutter to a building of claim 5 further comprising an extension adjacent said base of said gutter clip.

7. The gutter retaining system for mounting a rain gutter to a building of claim 6 further comprising a first elbow between said vertical portion and said base of said gutter clip.

8. The gutter retaining system for mounting a rain gutter to a building of claim 7 further comprising a second elbow between said base and said extension of said gutter clip.

9. A gutter retaining system for mounting a rain gutter to a building comprising:

a retaining member comprising a vertical portion contiguous with an upper portion, an angled member angled downward from said upper portion, and a hooked portion positioned at the end of said angled member;

a gutter having a front wall, a bottom wall adjacent said front wall and a back wall adjacent said bottom wall, said back wall having an interior surface, an outer surface and a top edge;

a gutter clip adjacent said retaining member and said back wall of said gutter, wherein said gutter clip has a locking tip contiguous with a nib end, said nib end being adjacent a hanger portion, said hanger portion being contiguous with a u-portion, said u-portion being adjacent a vertical portion, said hanger portion and said vertical portion being approximately parallel, with said nib end angled outwardly from said hanger portion and said locking tip being angled inwardly toward said vertical portion from said nib end, said hanger portion, said nib end and said locking tip fitting within said gutter and said retaining member and being disposed substantially adjacent said interior surface of said back wall of said gutter, said u-portion receiving said top edge of said back wall of said gutter, and said vertical portion being disposed adjacent said outer surface of said back wall of said gutter; and a debris guard comprising a first side for attachment to said angled member of said retaining member and a second side for mating to said front wall of said gutter.

10. The gutter retaining system for mounting a rain gutter to a building of claim 9 further comprising a base adjacent said vertical portion of said gutter clip, said base extending outward from said outer surface of said back wall of said gutter.

11. The gutter retaining system for mounting a rain gutter to a building of claim 10 further comprising an extension adjacent said base of said gutter clip.

12. The gutter retaining system for mounting a rain gutter to a building of claim 11 further comprising a first elbow between said vertical portion and said base of said gutter clip.

13. The gutter retaining system for mounting a rain gutter to a building of claim 12 further comprising a second elbow between said base and said extension of said gutter clip.

14. The gutter retaining system for mounting a rain gutter to a building of claim 9 further comprising a base extending at an angle from said vertical portion of said retaining member.

15. The gutter retaining system for mounting a rain gutter to a building of claim 9 further comprising an upward facing lip attached to said hooked portion of said retaining member.

16. The gutter retaining member for mounting a rain gutter to a building of claim 15 wherein said debris guard further comprises a downward facing lip at one side for mating with said upward facing lip of said retaining member and a mounting means at its opposing side for attachment to said gutter.

* * * * *